US011441750B2

(12) United States Patent
Sugihara et al.

(10) Patent No.: US 11,441,750 B2
(45) Date of Patent: Sep. 13, 2022

(54) LIGHTING TOOL FOR VEHICLE

(71) Applicant: STANLEY ELECTRIC CO., LTD., Tokyo (JP)

(72) Inventors: Yuki Sugihara, Tokyo (JP); Shota Nishimura, Tokyo (JP); Shinya Hoshino, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/372,196

(22) Filed: Jul. 9, 2021

(65) Prior Publication Data

US 2022/0018510 A1 Jan. 20, 2022

(30) Foreign Application Priority Data

Jul. 20, 2020 (JP) ..... JP2020-123529

(51) Int. Cl.

| | |
|---|---|
| ***F21S 41/25*** | (2018.01) |
| ***F21S 41/24*** | (2018.01) |
| ***F21S 41/43*** | (2018.01) |
| ***F21V 5/04*** | (2006.01) |
| *F21Y 115/10* | (2016.01) |
| *F21W 102/13* | (2018.01) |

(52) U.S. Cl.

CPC ..... *F21S 41/25* (2018.01); *F21S 41/24* (2018.01); *F21S 41/43* (2018.01); *F21V 5/04* (2013.01); *F21W 2102/13* (2018.01); *F21Y 2115/10* (2016.08)

(58) Field of Classification Search

None

See application file for complete search history.

(56) References Cited

U.S. PATENT DOCUMENTS

| | | | |
|---|---|---|---|
| 10,352,524 | B1 | 7/2019 | Hong et al. |
| 2016/0369966 | A1 | 12/2016 | Kuwata et al. |
| 2019/0086050 | A1 | 3/2019 | Dikau et al. |
| 2019/0226658 | A1 | 7/2019 | Kawai et al. |

FOREIGN PATENT DOCUMENTS

| | | | |
|---|---|---|---|
| DE | 11 2014 003 720 | T5 | 5/2016 |
| DE | 10 2016 111 501 | A1 | 12/2017 |
| EP | 3 248 840 | A1 | 11/2017 |
| EP | 3 508 777 | A1 | 7/2019 |
| WO | 2016/162921 | A1 | 10/2016 |
| WO | 2018/043663 | A1 | 3/2018 |

OTHER PUBLICATIONS

The extended European Search Report for the related European Patent Application No. 21185316.3 dated Sep. 29, 2021.

*Primary Examiner* — Elmito Breval

(74) *Attorney, Agent, or Firm* — Kenealy Vaidya LLP

(57) ABSTRACT

A projection lens has a first lens body including a first incidence section disposed at a side facing a first light source and a first emitting section disposed at a side opposite to the first incidence section, and a second lens body including a second incidence section disposed at a side facing a second light source and a second emitting section disposed at a side opposite to the second incidence section, a structure in which the first lens body and the second lens body abut against each other via an intermediate layer which is interposed between facing boundary surfaces of the first lens body and the second lens body is provided, and a refractive index of the intermediate layer is smaller than a refractive index of the first lens body.

6 Claims, 2 Drawing Sheets

LIGHTING TOOL FOR VEHICLE

CROSS-REFERENCE TO RELATED APPLICATION

Priority is claimed on Japanese Patent Application No. 2020-123529, filed Jul. 20, 2020, the content of which is incorporated herein by reference.

BACKGROUND OF THE INVENTION

Field of the Invention

The present invention relates to a lighting tool for a vehicle.

Description of Related Art

For example, a lighting tool for a vehicle such as a headlight for a vehicle (headlamp) or the like includes a light source, a reflector configured to reflect light emitted from the light source in a direction in which the vehicle advances, a shade configured to shield (cut) some of the light reflected by the reflector, and a projection lens configured to project the light, some of which is cut by the shade, in the direction in which the vehicle advances.

In such a lighting tool for a vehicle, when a light source image defined by a front end of the shade is reversed and projected by the projection lens as a passing beam (low beam), a light distribution pattern for a low beam including a cutoff line is formed on an upper end of the shade.

In addition, in the lighting tool for a vehicle, when another light source configured to emit light in the direction in which the vehicle advances is disposed below the shade and light emitted from this light source is projected by the projection lens as a traveling beam (high beam), a light distribution pattern for a high beam is formed above the light distribution pattern for a low beam.

Incidentally, in a lighting tool for a vehicle disclosed in PCT International Publication No. 2018/043663, instead of the above-mentioned reflector and shade, forming a light distribution pattern for a low beam and a light distribution pattern for a high beam using two light guide members provided to correspond to two upper and lower light sources is proposed.

SUMMARY OF THE INVENTION

However, in the lighting tool for a vehicle disclosed in PCT International Publication No. 2018/043663, since an air layer (air gap) is present between the two light guide members, efficiency of utilization of the light emitted from the light source is decreased due to Fresnel loss generated therebetween. In addition, the light distribution pattern may vary due to a variation in positional accuracy (in particular, an interval between the air gaps) of the two light guide members. Further, when the light is totally reflected between an upper surface of the lower light guide member and the air layer, a defect (a dark section) may occur on the side of a lower section of the light distribution pattern for a high beam.

The aspect of aspect of the present invention is directed to providing a lighting tool for a vehicle capable of obtaining a good light distribution pattern.

In order to accomplish the above-mentioned purpose, the present invention provides the following means.

(1) A lighting tool for a vehicle including:

a first light source configured to emit first light;

a second light source that is disposed adjacent to the first light source and that is configured to emit second light in a same direction as the first light; and a projection lens configured to project the first light and the second light in a same direction, wherein the projection lens has a first lens body including a first incidence section disposed at a side facing the first light source and a first emitting section disposed at a side opposite to the first incidence section, and a second lens body including a second incidence section disposed at a side facing the second light source and a second emitting section disposed at a side opposite to the second incidence section, a refractive index of the second lens body is smaller than a refractive index of the first lend body, a structure in which the first lens body and the second lens body abut against each other via an intermediate layer which is interposed between facing boundary surfaces of the first lens body and the second lens body is provided, a refractive index of the intermediate layer is smaller than the refractive index of the first lens body, among the first light that has entered inside of the first lens body from the first incidence section, the first light reflected at the boundary surface is emitted from the first emitting section to an outside of the first lens body, and among the second light that has entered inside of the second lens body from the second incidence section, the second light that has passed through the boundary surface is emitted from the first emitting section to the outside of the first lens body.

(2) The lighting tool for a vehicle according to the above-mentioned (1), wherein the refractive index of the second lens body is equal to or smaller than the refractive index of the intermediate layer.

(3) The lighting tool for a vehicle according to the above-mentioned (1) or (2), wherein the projection lens has a third lens body that is disposed at a side facing the first emitting section and the second emitting section, and the third lens body has a lens surface configured to condense the first light and the second light emitted from the first emitting section and the second emitting section in a direction in which the first light source and the second light source are aligned.

(4) The lighting tool for a vehicle according to the above-mentioned (3), wherein the third lens body is disposed in a state in which an air layer is provided between the first emitting section and the second emitting section.

(5) The lighting tool for a vehicle according to any one of the above-mentioned (1) to (4), wherein the first light source and the second light source are provided on a same surface of a same substrate.

(6) The lighting tool for a vehicle according to any one of the above-mentioned (1) to (5), wherein the first light projected by the projection lens forms a first light distribution pattern including a cutoff line defined by a tip of the boundary surface on an upper end thereof, and the second light projected by the projection lens forms a second light distribution pattern disposed above the first light distribution pattern.

According to the aspect of the present invention, it is possible to provide a lighting tool for a vehicle capable of obtaining a good light distribution pattern.

DETAILED DESCRIPTION OF THE INVENTION

Figure 1:
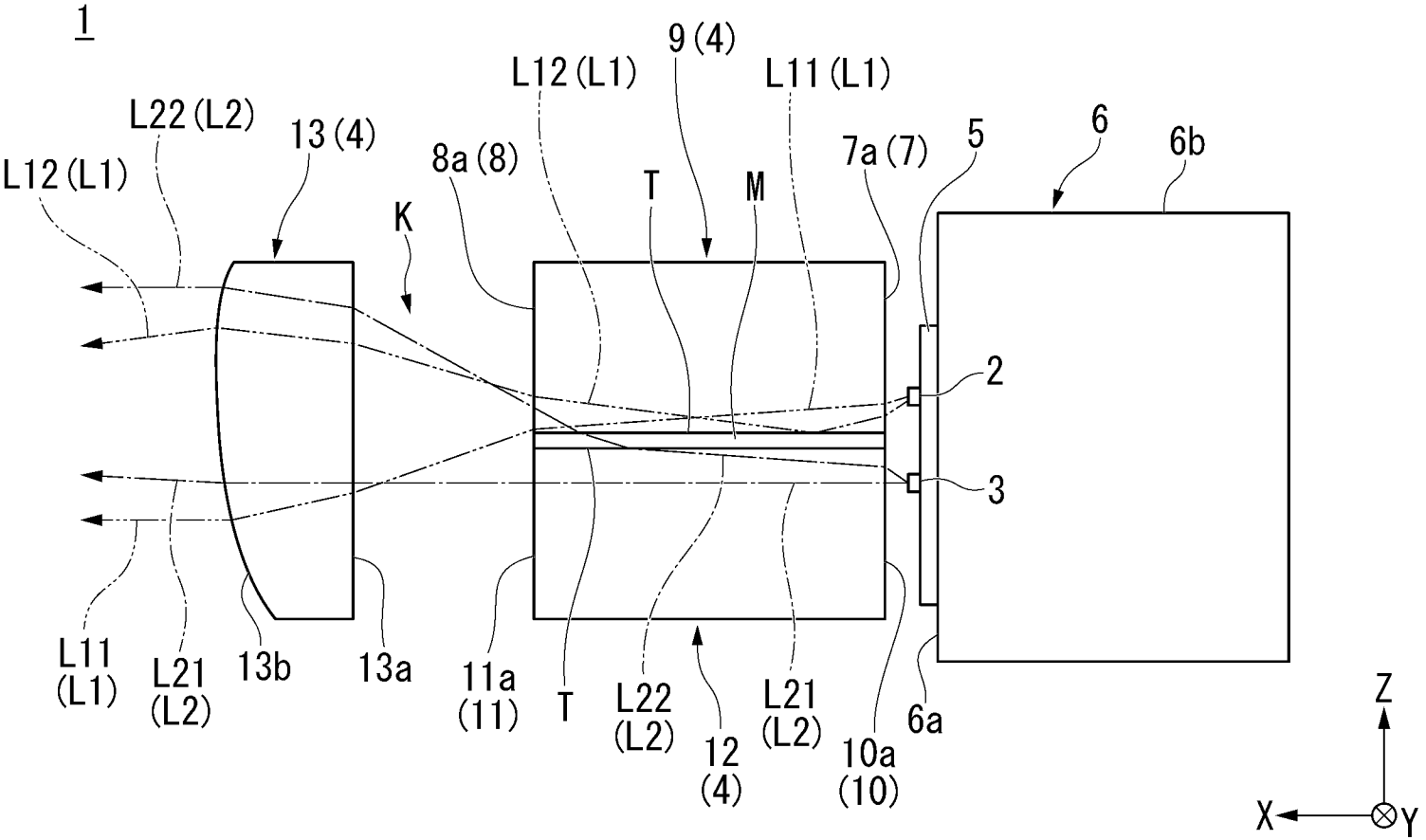
FIG. 1 is a cross-sectional view showing a configuration of a lighting tool for a vehicle according to an embodiment of the present invention.

Hereinafter, an embodiment of the present invention will be described in detail with reference to the accompanying drawings.

Further, in the drawings used in the following description, in order to make components easier to see, scales of dimensions may be shown differently depending on the components, and dimensional ratios or the like of the components are not always the same as the actual ones.

In addition, in the drawings described below, an XYZ orthogonal coordinate system is set, an X-axis direction indicates a forward/rearward direction (a lengthwise direction) of a lighting tool for a vehicle, a Y-axis direction indicates a leftward/rightward direction (a widthwise direction) of the lighting tool for a vehicle, and a Z-axis direction indicates an upward/downward direction (a height direction) of the lighting tool for a vehicle.

First Embodiment

First, as a first embodiment of the present invention, for example, a lighting tool 1 for a vehicle shown in FIG. 1 and FIG. 2 will be described. Further, FIG. 1 is a cross-sectional view showing a configuration of the lighting tool 1 for a vehicle.

The lighting tool 1 for a vehicle of the embodiment is a headlight for a vehicle (headlamp) in which the present invention is applied, and is configured to emit a passing beam (low beam) that forms a light distribution pattern for a low beam including a cutoff line on an upper end thereof and a traveling beam (high beam) that forms a light distribution pattern for a high beam above the light distribution pattern for a low beam toward a front of the vehicle (in a +X-axis direction) in a switchable manner.

Figure 2:
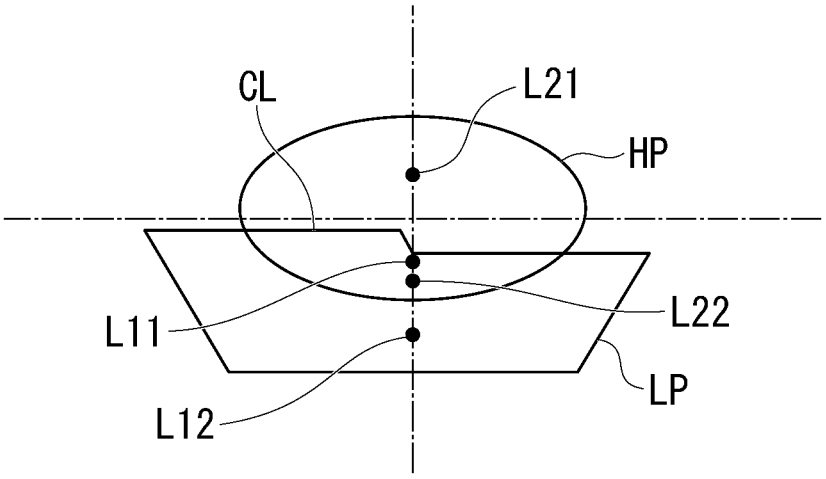
FIG. 2 is a schematic view showing a light distribution pattern for a low beam formed by first light and a light distribution pattern for a high beam formed by second light.

Specifically, as shown in FIG. 1, the lighting tool 1 for a vehicle generally includes a first light source 2 configured to emit first light L1, a second light source 3 configured to emit second light L2, and a projection lens 4 configured to project the first light L1 and the second light L2, at inside of a lighting body (not shown).

Further, the lighting body is constituted by a housing, a front surface of which is opened, and a transparent lens cover configured to cover an opening of the housing. In addition, a shape of the lighting body can be appropriately changed according to a design or the like of the vehicle.

The first light source 2 and the second light source 3 are constituted by, for example, light emitting diodes (LEDs) that emit white light. In addition, a high output (high brightness) type LED for vehicle illumination (for example, an SMD LED or the like) may be used. Further, in the first light source 2 and the second light source 3, in addition to the above-mentioned LED, for example, a light emitting element such as a laser diode (LD) or the like can be used.

In the lighting tool 1 for a vehicle of the embodiment, the first light source 2 and the second light source 3 are arranged in a vertical direction (an upward/downward direction) of the lighting tool 1 for a vehicle in a state in which they are adjacent to each other. Among these, one LED that constitutes the first light source 2 is disposed on an upper side, and one LED that constitutes the second light source 3 is disposed on a lower side.

The first light source 2 and the second light source 3 are mounted on the side of one surface (in the embodiment, a front surface) of a circuit substrate 5 on which a driving circuit configured to drive the LEDs is provided. Accordingly, the first light source 2 and the second light source 3 radially emit the first light L1 and the second light L2 toward a front side (a side of a +X axis). That is, the first light source 2 and the second light source 3 are provided on the same surface of the same circuit substrate 5, and are configured to radially emit the first light L1 and the second light L2 in the same direction.

In addition, a heat sink 6 configured to radiate heat emitted from the first light source 2 and the second light source 3 is attached to the side of the other surface (in the embodiment, a back surface) of the circuit substrate 5. The heat sink 6 is constituted by an extruded molding body formed of a metal having a high thermal conductivity such as aluminum or the like. The heat sink 6 has a base section 6*a* in contact with the circuit substrate 5, and a plurality of fin sections 6*b* configured to increase heat radiation of heat transmitted from the circuit substrate 5 to the base section 6*a*.

Further, while this embodiment has a configuration in which the LEDs that constitute the first light source 2 and the second light source 3, and the driving circuit configured to drive the LEDs are mounted on the circuit substrate 5, a configuration in which a mounting substrate on which LEDs are mounted and a circuit substrate on which a driving circuit configured to drive the LEDs is provided are separately disposed, the mounting substrate and the circuit substrate are electrically connected to each other via a wiring cord referred to as a harness, and thus the driving circuit is protected from heat emitted from the LEDs is also possible.

The projection lens 4 has a first lens body 9 including a first incidence section 7 disposed at a side facing the first light source 2 and a first emitting section 8 disposed at a side opposite to the first incidence section 7, a second lens body 12 including a second incidence section 10 disposed at a side facing the second light source 3 and a second emitting section 11 disposed at a side opposite to the second incidence section 10, and a third lens body 13 disposed at a side facing the first emitting section 8 and the second emitting section 11.

In the projection lens 4, a refractive index of the second lens body 12 is smaller than a refractive index of the first lens body 9. In the embodiment, for example, the first lens body 9 is formed of a polycarbonate resin (PC), and the second lens body 12 is formed of an acryl resin (PMMA).

Further, the combination of materials having different refractive indices of the first lens body 9 and the second lens body 12 is not necessarily limited to such a combination, and may be appropriately changed. In addition, the materials are not limited to the above-mentioned resins having optical transparency, and glass may also be used.

The projection lens 4 has a structure in which the first lens body 9 and the second lens body 12 abut against each other via an intermediate layer M which is interposed between boundary surfaces T facing each other in the upward/downward direction of the first lens body 9 and the second lens body 12.

The intermediate layer M is formed of a binding material with optical transparency that joins the first lens body 9 and the second lens body 12. In addition, a thickness of the intermediate layer M may be a thickness sufficient to join the first lens body 9 and the second lens body 12. In the projection lens 4, a refractive index of the intermediate layer M is smaller than a refractive index of the first lens body 9.

In addition, the refractive index of the second lens body 12 may be equal to or smaller than the refractive index of the intermediate layer M. That is, the refractive index of the second lens body 12 may be the same as the refractive index of the intermediate layer M, or the refractive index of the intermediate layer M may be greater than the refractive index of the second lens body 12.

Meanwhile, when making a difference (a critical angle) between the refractive indices of the first lens body 9 and the intermediate layer M great, it is preferable to use the intermediate layer M having a value close to the refractive index of the second lens body 12. A binding material that satisfies such a condition can be appropriately selected from known binding materials and can be used for the intermediate layer M.

The first lens body 9 and the second lens body 12 are joined to each other via the intermediate layer M, which serves as a binding material, without having the air layer present between the boundary surfaces T by abutting the facing boundary surfaces T against each other in the upward/downward direction. In addition, tips of the boundary surfaces T define a cutoff line of the above-mentioned light distribution pattern for a low beam while extending in the horizontal direction (the leftward/rightward direction) of the lighting tool 1 for a vehicle.

The first incidence section 7 has a first incidence surface 7*a* on which the first light L1 radially emitted from the first light source 2 is incident at a position facing the first light source 2. The first incidence surface 7*a* is constituted by a flat surface. The first light L1 that enters inside of the first lens body 9 from the first incidence surface 7*a* (the first incidence section 7) is guided toward the first emitting section 8 in front of the first lens body 9. Among this, the first light L1 incident on the boundary surface T is guided toward the first emitting section 8 by being reflected at the boundary surface T.

That is, at the boundary surface T, since the refractive index of the intermediate layer M is made smaller than the refractive index of the first lens body 9, it is possible to totally reflect the first light L1 incident on the boundary surface T toward the first emitting section 8.

The second incidence section 10 has a second incidence surface 10*a* on which the second light L2 radially emitted from the second light source 3 is incident at a position facing the second light source 3. The second incidence surface 10*a* is constituted by a flat surface. The second light L2 that enters inside of the second lens body 12 from the second incidence surface 10*a* (the second incidence section 10) is guided toward the second emitting section 11 in front of the second lens body 12. Among this, the second light L2 incident on the boundary surface T passes through the boundary surface T and enters the first lens body 9. The second light L2 that has entered the inside of the first lens body 9 is guided toward the first emitting section 8.

That is, at the boundary surface T, since the refractive index of the intermediate layer M and the second lens body 12 are made smaller than the refractive index of the first lens body 9, it is possible to make the second light L2 incident on the boundary surface T to pass toward the second emitting section 11.

The first emitting section 8 has a first emitting surface 8*a* on the side of a front surface of the first lens body 9. The second emitting section 11 has a second emitting surface 11*a* on the side of a front surface of the second lens body 12. The first emitting surface 8*a* and the second emitting surface 11*a* are constituted by flat surfaces continuous with each other.

In the first emitting section 8, the first light L1 and the second light L2 guided into inside of the first lens body 9 are emitted from the first emitting surface 8*a* to the outside of the first lens body 9. In the second emitting section 11, the second light L2 guided into inside of the second lens body 12 is emitted from the second emitting surface 11*a* to the outside of the second lens body 12.

Further, in the surfaces that constitute the first lens body 9 and the second lens body 12, the other surfaces that are not shown or explained can be freely designed (for example, blocked or the like) within a range in which there is no bad influence on the first light L1 and the second light L2 passing through the inside of the first lens body 9 and the second lens body 12.

The third lens body 13 is disposed in a state in which an air layer K is provided between the first emitting section 8 and the second emitting section 11. The third lens body 13 has a third incidence surface 13*a*, on which the first light L1 and the second light L2 are incident, on the side of a back surface thereof, and a third emitting surface 13*b*, from which the first light L1 and the second light L2 are emitted, on the side of a front surface thereof.

The third incidence surface 13*a* is constituted by a flat surface. The third emitting surface 13*b* is constituted by a convex lens surface having a spherical shape or an aspherical shape that condenses the first light L1 and the second light L2 in the vertical direction (a direction in which the first light source 2 and the second light source 3 are aligned) and a horizontal direction (a direction in which the boundary surface T extends) of the lighting tool 1 for a vehicle. In addition, a focus of the convex lens surface (the third emitting surface 13*b*) is set on a tip of the boundary surface T or at the vicinity thereof.

In the third lens body 13, after the first light L1 and the second light L2 emitted from the third emitting surface 13*b* are condensed, the first light L1 and the second light L2 are enlarged and projected toward a front of the third lens body 13 (the projection lens 4) by being diffused in the horizontal direction and the vertical direction of the lighting tool 1 for a vehicle.

Further, the third lens body 13 is not limited to the configuration in which the third incidence surface 13*a* is constituted by the flat surface and may have a configuration in which the third incidence surface 13*a* is constituted by a convex lens surface.

In addition, in the surfaces that constitute the third lens body 13, the other surfaces that are not shown or explained can be freely designed (for example, blocked or the like) within a range in which there is no bad influence on the first light L1 and the second light L2 passing through the inside of the third lens body 13.

In the lighting tool 1 for a vehicle of the embodiment having the above-mentioned configuration, the first light L1 emitted from the first light source 2 is projected by the projection lens 4 in the direction in which the vehicle advances as a passing beam (low beam). Here, the first light L1 projected toward the front of the projection lens 4 forms a light distribution pattern for a low beam (a first light distribution pattern), which includes a cutoff line defined by the tip of the boundary surface T on an upper end, by reversing and projecting a light source image formed in the vicinity of the focus of the third emitting surface 13*b*.

Meanwhile, in the lighting tool 1 for a vehicle of the embodiment, the first light L1 and the second light L2 emitted from the first light source 2 and the second light source 3 are projected by the projection lens 4 in the direction in which the vehicle advances as a traveling beam (high beam). Here, the second light L2 projected toward the front of the projection lens 4 forms a second light distribution pattern disposed above a light distribution pattern for a low beam (a first light distribution pattern). The light distribution pattern for a high beam is formed by overlapping this second light distribution pattern and the light distribution pattern for a low beam (a first light distribution pattern) formed by the first light L1.

In the first light L1 that enters the first lens body 9, first light L11 guided toward the first emitting section 8 is emitted from the first emitting section 8 to the outside of the first lens body 9. Further, the first light L11 emitted to the outside of the first lens body 9 enters the inside of the third lens body 13 from the third incidence surface 13*a* via the air layer K, and is emitted from the third emitting surface 13*b* to the outside of the third lens body 13. Accordingly, the first light L11 forms a light distribution pattern at the vicinity of a cutoff line CL in a light distribution pattern for a low beam LP shown in FIG. 2.

Meanwhile, first light L12 incident on the boundary surface T is guided toward the first emitting section 8 after being reflected at the boundary surface T, and is emitted from the first emitting section 8 to the outside of the first lens body 9. Further, the first light L12 emitted to the outside of the first lens body 9 enters the inside of the third lens body 13 from the third incidence surface 13*a* via the air layer K, and is emitted from the third emitting surface 13*b* to the outside of the third lens body 13. Accordingly, the first light L12 forms a light distribution pattern below a line H-H in the light distribution pattern for a low beam LP shown in FIG. 2.

In the second light L2 that has entered the second lens body 12, second light L21 guided toward the second emitting section 11 is emitted from the second emitting section 11 to the outside of the second lens body 12. Further, the second light L21 emitted to the outside of the second lens body 12 enters the inside of the third lens body 13 from the third incidence surface 13*a* via the air layer K, and is emitted from the third emitting surface 13*b* to the outside of the third lens body 13. Accordingly, the second light L21 forms a light distribution pattern above the line H-H in a light distribution pattern for a high beam HP shown in FIG. 2.

Meanwhile, second light L22 incident on the boundary surface T passes through the boundary surface T, is guided toward the first emitting section 8 after entering the inside of the first lens body 9, and is emitted from the first emitting section 8 to the outside of the first lens body 9. Further, the second light L22 emitted to the outside of the first lens body 9 enters inside of the third lens body 13 from the third incidence surface 13*a* via the air layer K, and is emitted from the third emitting surface 13*b* to the outside of the third lens body 13. Accordingly, the second light L22 forms a light distribution pattern below the light distribution pattern for a high beam HP shown in FIG. 2.

In addition, the second light L22 incident on the boundary surface T approaches a position or a beam angle of the first light L12 reflected at the boundary surface T when passing through the boundary surface T. Accordingly, since the second light L22 is emitted below the cutoff line CL of the light distribution pattern for a low beam LP, a lower side of the light distribution pattern for a high beam HP shown in FIG. 2 can overlap the cutoff line CL of the light distribution pattern for a low beam LP.

As described above, in the lighting tool 1 for a vehicle of the embodiment, a good light distribution pattern for a low beam and a good light distribution pattern for a high beam can be obtained by projecting the above mentioned first light L1 and the second light L2 emitted from the first light source 2 and the second light source 3 using the projection lens 4.

In addition, in the lighting tool 1 for a vehicle of the embodiment, the first lens body 9 and the second lens body 12 that constitute the projection lens 4 are joined to each other via the intermediate layer M without having the air layer present between the boundary surfaces T by abutting the boundary surfaces T against each other while having the intermediate layer M interposed therebetween.

Accordingly, in the lighting tool 1 for a vehicle of the embodiment, it is possible to prevent occurrence of Fresnel loss between the boundary surfaces T, and it is possible to increase efficiency of utilization of the first light L1 and the second light L2 emitted from the first light source 2 and the second light source 3.

Further, the present invention is not necessarily limited to the above embodiment and various modifications may be made without departing from the scope of the present invention.

For example, the lighting tool for a vehicle to which the present invention is applied is appropriately used for the above-mentioned headlight for a vehicle (headlamp), but the lighting tool for a vehicle of the present invention is not limited to the lighting tool for a vehicle on the front side, and for example, the present invention can also be applied to a lighting tool for a vehicle on the rear side such as a rear combination lamp or the like.

That is, the present invention can be widely applied to lighting tools for a vehicle including the first light source configured to emit first light, the second light source disposed adjacent to the first light source and configured to emit second light in the same direction as the first light, and the projection lens configured to project the first light and the second light in the same direction.

In addition, the first light source and the second light source are not limited to the above-mentioned LED, and for example, a light emitting element such as a laser diode (LD) or the like may also be used. In addition, color of the first light and the second light is not limited to the above-mentioned white light, and red light, orange light, or the like can be appropriately used according to purposes thereof. Further, a configuration in which the first light source and the second light source selectively emit the first light and the second light with different colors can also be provided.

In addition, while the direction in which the first light source 2 and the second light source 3 are aligned next to each other is the vertical direction of the lighting tool 1 for a vehicle and the direction in which the boundary surface T extends is the horizontal direction of the lighting tool 1 for a vehicle in the lighting tool 1 for a vehicle, the present invention may also be applied to a lighting tool for a vehicle in which the direction in which the first light source and the second light source are aligned next to each other is the horizontal direction of the lighting tool for a vehicle and the direction in which the boundary surface T extends is the vertical direction of the lighting tool for a vehicle.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A lighting tool for a vehicle comprising:

a first light source configured to emit first light;

a second light source that is disposed adjacent to the first light source and that is configured to emit second light in a same direction as the first light; and a projection lens configured to project the first light and the second light in a same direction, wherein the projection lens has a first lens body including a first incidence section disposed at a side facing the first light source and a first emitting section disposed at a side opposite to the first incidence section, and a second lens body including a second incidence section disposed at a side facing the second light source and a second emitting section disposed at a side opposite to the second incidence section, a refractive index of the second lens body is smaller than a refractive index of the first lend body, a structure in which the first lens body and the second lens body are joined to each other via an intermediate layer which is interposed between facing boundary surfaces of the first lens body and the second lens body, and the intermediate layer is a binding material with optical transparency, a refractive index of the intermediate layer is smaller than the refractive index of the first lens body, the refractive index of the second lens body is equal to or smaller than the refractive index of the intermediate layer, among the first light that has entered inside of the first lens body from the first incidence section, the first light reflected at the boundary surface is emitted from the first emitting section to an outside of the first lens body, and among the second light that has entered inside of the second lens body from the second incidence section, the second light that has passed through the boundary surface is emitted from the first emitting section to the outside of the first lens body.

2. The lighting tool for a vehicle according to claim 1, wherein the first lens body is a polycarbonate resin, and the second lens body is an acryl resin (PMMA).

3. The lighting tool for a vehicle according to claim 1, wherein the projection lens has a third lens body that is disposed at a side facing the first emitting section and the second emitting section, and the third lens body has a lens surface configured to condense the first light and the second light emitted from the first emitting section and the second emitting section in a direction in which the first light source and the second light source are aligned.

4. The lighting tool for a vehicle according to claim 3, wherein the third lens body is disposed in a state in which an air layer is provided between the first emitting section and the second emitting section.

5. The lighting tool for a vehicle according to claim 1, wherein the first light source and the second light source are provided on a same surface of a same substrate.

6. The lighting tool for a vehicle according to claim 1, wherein the first light projected by the projection lens forms a first light distribution pattern including a cutoff line defined by a tip of the boundary surface on an upper end thereof, and the second light projected by the projection lens forms a second light distribution pattern disposed above the first light distribution pattern.

* * * * *